United States Patent [19]

Vollerin

[11] 4,171,946

[45] Oct. 23, 1979

[54] BURNER FOR COMBUSTIBLE FLUIDS

[75] Inventor: Bernard Vollerin, Geneva, Switzerland

[73] Assignee: Pietro Fascione, Milan, Italy

[21] Appl. No.: 773,014

[22] Filed: Feb. 28, 1977

[30] Foreign Application Priority Data

Feb. 27, 1976 [CH] Switzerland ..... 2417/76

[51] Int. Cl.[2] ..... F23M 9/00

[52] U.S. Cl. ..... 431/183; 431/353

[58] Field of Search ..... 431/182, 183, 184, 185, 431/265, 353, 158; 239/399, 403, 405, 406

[56] References Cited

U.S. PATENT DOCUMENTS

| | | | |
|---|---|---|---|
| 2,806,517 | 9/1957 | Nuyl | 431/183 |
| 2,818,109 | 12/1957 | Voorheis | 431/184 |
| 3,049,173 | 8/1962 | Costello et al. | 431/184 |
| 3,076,497 | 2/1963 | Robb | 431/183 X |
| 3,476,494 | 11/1969 | Buchanan et al. | 431/182 X |
| 3,672,812 | 6/1972 | Bendixen | 431/183 X |

FOREIGN PATENT DOCUMENTS

| | | | |
|---|---|---|---|
| 1218129 | 12/1959 | France | 431/265 |

*Primary Examiner*—Edward G. Favors
*Attorney, Agent, or Firm*—Karl F. Ross

[57] ABSTRACT

A burner for combustible fluids has a distribution opening adapted to feed a combustion chamber and supplied by a source of a comburant (combustion-sustaining gas such as air or a mixture of air and combustion products), a swirl generator between this source and the opening, an injection nozzle for the combustible fluid extending coaxially through this opening, and a constriction located immediately ahead of the discharge end of the nozzle and adjacent an outwardly diverging passage adapted to generate a toroidal vortex in the region of the end of the nozzle.

6 Claims, 3 Drawing Figures

BURNER FOR COMBUSTIBLE FLUIDS

CROSS-REFERENCE TO RELATED APPLICATION

This application is related to the commonly owned application Ser. No. 656,079 filed Feb. 6, 1976 by the present applicant among others (now U.S. Pat. No. 4,089,629).

FIELD OF THE INVENTION

The present invention relates to a burner for combustible fluids and, more particularly, to a burner for fuel oil using a comburant (air or mixture of combustion product gases and air as an oxygen-containing medium) which provides a highly stable flame.

BACKGROUND OF THE INVENTION

Studies of combustion of a fluid discharged into a combustion chamber have shown that it is important to maintain an internal recirculation of the products of combustion and to fix the position of the flame for most effective stabilization of the combustion process. These desiderata can be achieved at least in part with the system described in the above-identified application. It is, consequently, possible to reduce the excess of air required for full combustion and to provide a Bacharach index in the combustion gas of an acceptable level.

As described in the aforementioned application, one particularly effective technique for assuring intensive internal recirculation of the combustion gases at the burner conjointly with an anchoring of the flame in the combustion chamber resides in introducing the gaseous comburant into this chamber with a helicoidal movement about the axis along which the combustible (fuel) is injected coaxially.

This vortex discharge, known as "swirl" produced a toroidal vortex which, in turn, induces a strong internal recirculation of a comburant gas and combustible mixture and the products of combustion, thereby increasing the possibility of their interaction, i.e. complete combustion, and assuring a vigorous mixture of the components.

As the intensity of the swirl increases, i.e. the kinetic moment of rotation increases in significance with respect to the axial mass flow, the more the toroidal vortex extends in the direction of the injection nozzle if the latter is disposed along the axis of generation of the swirl. As this vortex carries the particles of the combustible which have been incompletely burned, e.g. of soot or, in the case of a combustible liquid, of fuel oil, the latter tend to a deposit on the injection nozzle and accumulate thereon little by little, eventually obstructing the nozzle.

To overcome this disadvantage, it has already been proposed in the aforementioned application to provide an annular chamber around the nozzle which opens substantially at the discharge end of the nozzle and to feed this chamber with a portion of the mass of comburant gas supplied by the blower of the burner.

This system has been found to be most efficacious in preventing the accumulation of deposits upon the combustion nozzle using the flow of comburant extending axially along an annular zone concentric to the nozzle. However, it has been found that the toroidal vortex created by an intense swirl "rises" up to the neck of the burner and flows along the outer surface of the annular chamber, depositing particles of the combustible upon the walls thereof. These deposited particles are transformed into carbon and tarry deposits which encrust these walls.

Such particles of the combustible are capable of being accumulated on all surfaces which are encountered by them and hence all such surfaces tend to be similarly encrusted. The encrustation appears to be independent of the surface area or size of the surface encountered by the particles. For example, particles of the combustible are able to accumulate on the surface of the end of the wall of the tubular chamber which surrounds the nozzle in spite of the fact that it has a thickness of only about 1 mm.

This "rise" or outward movement of a strong swirl discharge arises at one or more points at which the local axial speed inverts with respect to the mean flow (so-called separation points). As the number of such points increases, there can be a sort of rupture of the "vortex", hereinafter referred to as vortex breakdown.

OBJECTS OF THE INVENTION

It is the principal object of the present invention to provide an improved burner for a combustible fluid in which the formation of deposits is eliminated or reduced.

Another object of this invention is to improve further a system of the type described in the aforementioned copending application.

Still another object of this invention is to provide a burner in which the tendency to vortex breakdown is reduced.

Yet another object of my invention is to extend the principles originally set forth in the above-identified copending application.

SUMMARY OF THE INVENTION

The present invention provides a burner for a combustible fuel which has a distribution opening adapted to communicate with a combustion chamber and a source of a gaseous comburant under pressure, a swirl generator between this source and the opening, and a Fuel-injection nozzle (combustible-feed nozzle) which extends coaxially through this opening and discharges at an end of the nozzle.

The burner of the present invention includes a constriction over a section of this opening disposed immediately ahead of the discharge end of the nozzle (immediately downstream thereof) and adjacent a flaring portion of the passage which extends downstream from this constriction so as to communicate to the comburant traversing this opening and passage at the constriction an acceleration designed to impede movement of the toroidal vortex generated by the swirl from approaching the region at the discharge end of the injection nozzle.

More particularly, the present invention provides a fuel-injection nozzle having a discharge end which is surrounded by a tubular member defining an angular passage through which a portion of the comburant flow is induced to pass, this tube terminating in a plane perpendicular to the axis of the nozzle and corresponding to the plane at which the combustible or fuel is discharged. Outwardly of this tube, an annular passage is formed which is provided with the aforementioned swirl-inducing means and through which the remainder of the comburant flow is passed under pressure from a blower.

According to the invention, the constriction begins at this plane and extends inwardly to terminate at a plane disposed parallel to the aforementioned plane but located somewhat downstream thereof.

The plane of maximum constriction also serves as the upstream terminus for an outwardly flaring wall member which widens toward the combustion chamber. The constriction, this wall portion and both passages are, of course, coaxial with the nozzle.

According to feature of the invention, the constriction is frustoconically convergent in the direction of flow of the comburant and the fuel while the outwardly flaring member is likewise frustoconical.

The convergence of the constriction may be such that the vertex of the cone which defines the constriction surface can lie at the plane perpendicular to the axis of the nozzle at which the outwardly flaring portion terminates, i.e. the downstream end of the axial flare. The vertex of this flaring portion can lie slightly upstream of the discharge end of the nozzle.

According to still another feature of the invention, the swirl-generating means includes a plurality of vanes disposed between the tube and the wall of the main comburant-flow passage and inclined to impart the desired swirl around the axis of the nozzle, these vanes being disposed at the discharge plane of the nozzle. In addition, upstream of the vanes, the passage can communicate with a spiral chamber or scroll which can be provided with another set of vanes for distributing the comburant into the passage. Upstream of the second set of vanes, moreover, means can be provided for feeding a portion of the comburant to the annular passage between the nozzle and the tube.

The scroll can be supplied by a blower mounted in a common housing with all of the aforementioned parts and communicating therewith tengentially.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
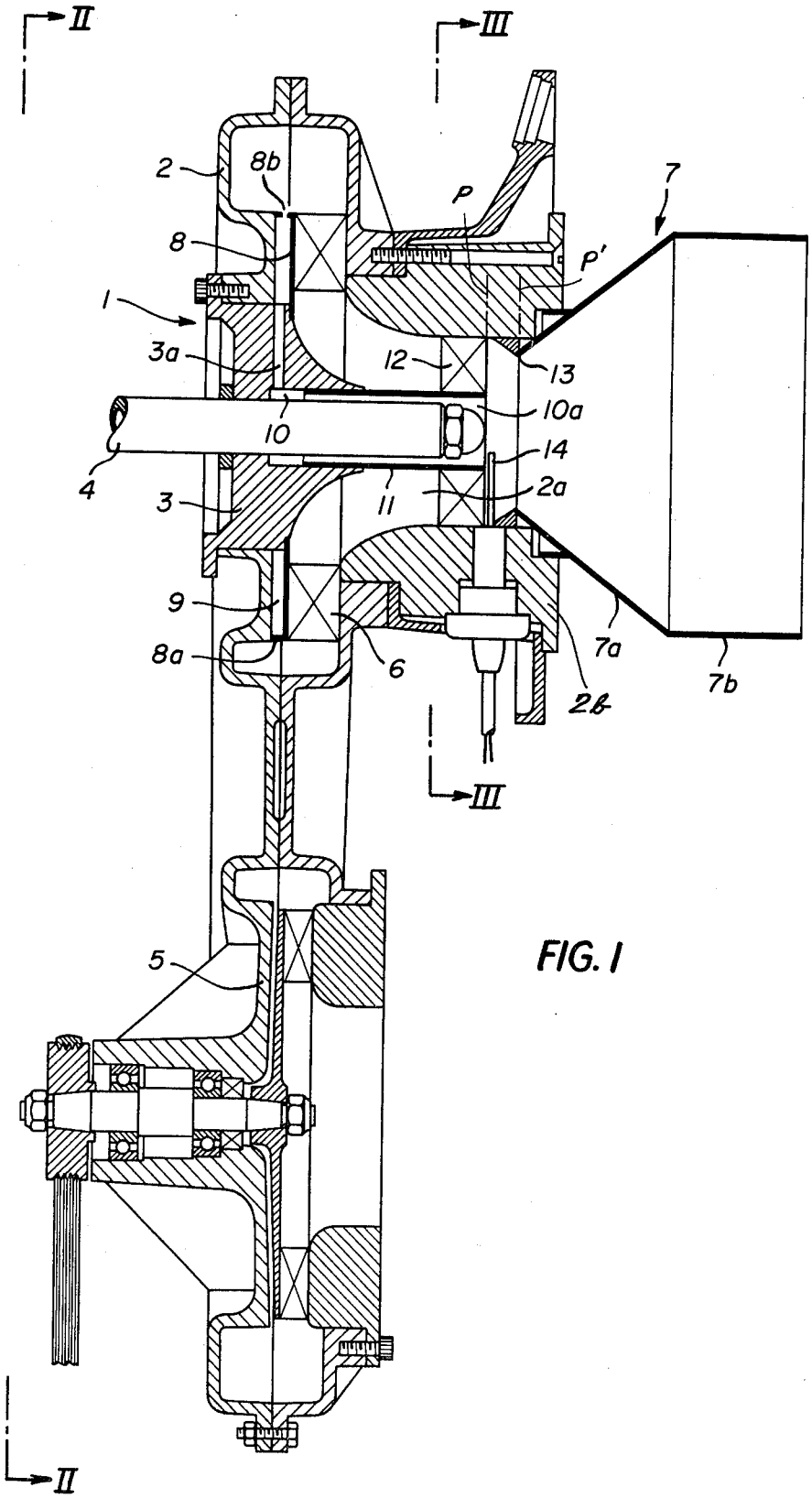
FIG. 1 is an axial cross-sectional view through a burner according to the present invention, its connection to the combustion chamber being of the type described in the aforementioned copending application.
Figure 2:
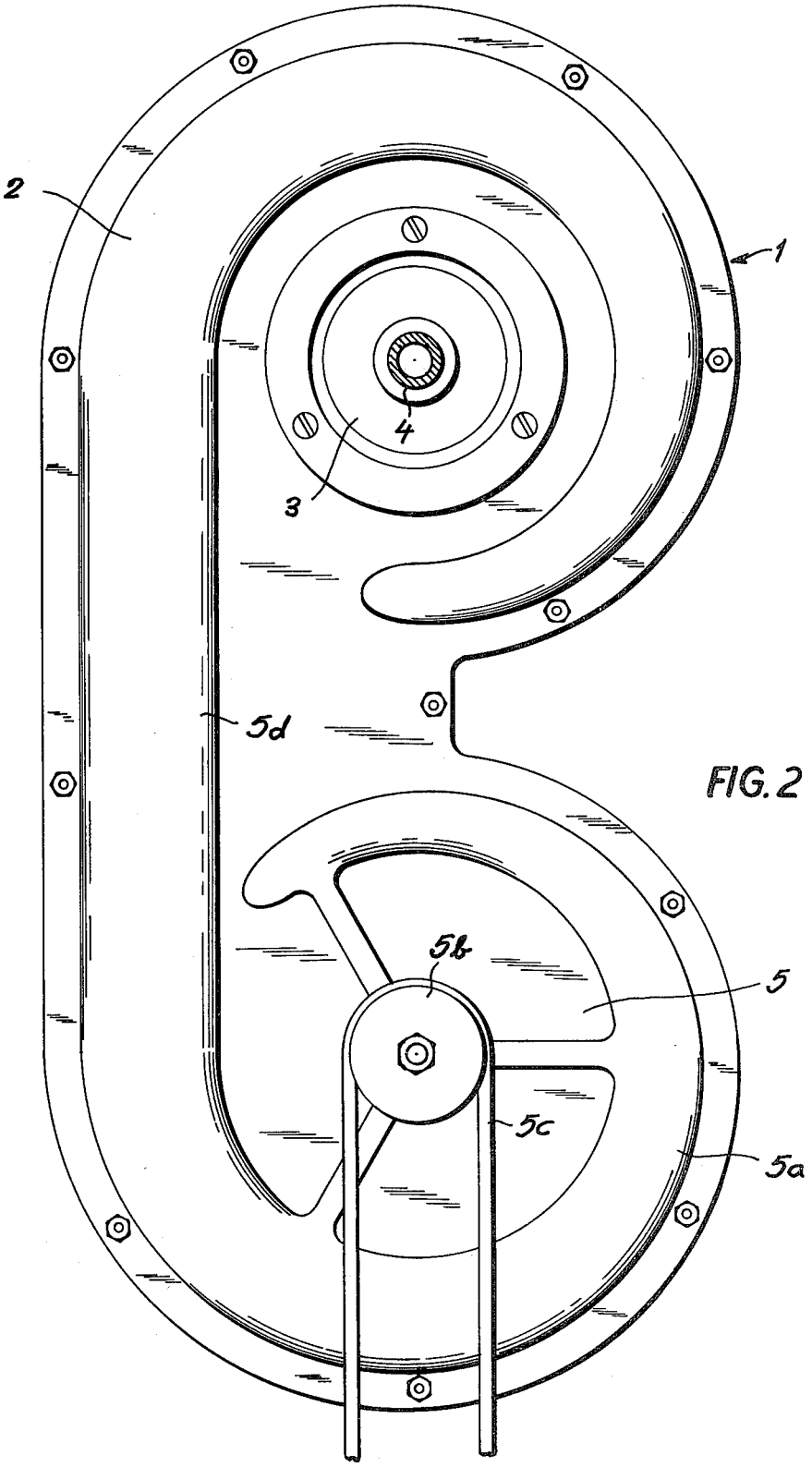
FIG. 2 is a view taken along the line II—II of FIG. 1.

The head of the burner 1 comprises a spiral scroll 2 which is provided with a nozzle carrier 3 centrally of the scroll and traversed axially by an opening in which a nozzle 4 is axially adjustably disposed. The nozzle 4, which can be connected to a fuel pump, can be of the type designed to atomize a combustible liquid, namely, a fuel oil.

The spiral scroll 2 is connected via a duct **5*d* to the spiral scroll 5*a* of a blower 5 which constitutes the source of comburant gases under pressure. The blower 5 can be driven by a pulley 5*b* engaged by the belts 5*c* which can, in turn, be propelled by an electric motor (not shown). The axial intake opening of the blower 5** can be connected with a source of air or oxygen and with the combustion chamber to produce an initial mixture of air and combustion gases constituting the "comburant" which is preferably a combustion sustaining mixture involving a so-called external recirculation of the combustion gases.

The scroll 2 is provided with a swirl generator comprising an array of fixed vanes 6 which are blades which can be spaced apart and inclined in accordance with the intensity of the swirl desired.

The blading 6 regulates the distribution of the comburant to the central distribution opening **2*a* of the scroll 2, this opening or passage 2*a* extending concentrically to the nozzle 4. The distribution opening communicates between the scroll 2 and a flame pot 7** disposed at the inlet to the combustion chamber which has not been shown in the drawing.

The flame pot comprises a conical portion (outwardly flared member) **7*a* adjacent the distribution opening 2*a*, and a cylindrical part 7*b* located downstream of the frustoconical portion 7*a*. The blading 6 is rigid with a disk 8 fixed on the nozzle carrier 3 and whose periphery is formed with a flange 8*a* closing off an annular space 9 which, however, communicates with the interior of the scroll 2 by openings 8*b* passing through the flange 8*a***.

The nozzle carrier 3 is formed with a multiplicity of angularly equispaced radial passages **3*a* which communicate between an annular chamber 10 surrounding the nozzle 4 and the annular space 9. The nozzle carrier 3 also receives a thin-walled tubular sleeve 11 which is coaxial with the nozzle 4 and extends from the chamber 10 to the plane perpendicular to the nozzle 4 at which the latter terminates, i.e. the right-hand extremity of this nozzle as shown in FIG. 1. The sleeve 11 thus defines an angular passage 10*a* closely surrounding the nozzle 4 which is fed with a portion of the comburant via orifices 8*b*, space 9, passages 3*a*, and chamber 10**, this gas flow passing axially along the nozzle to prevent encrustation of the discharge end thereof.

Figure 3:
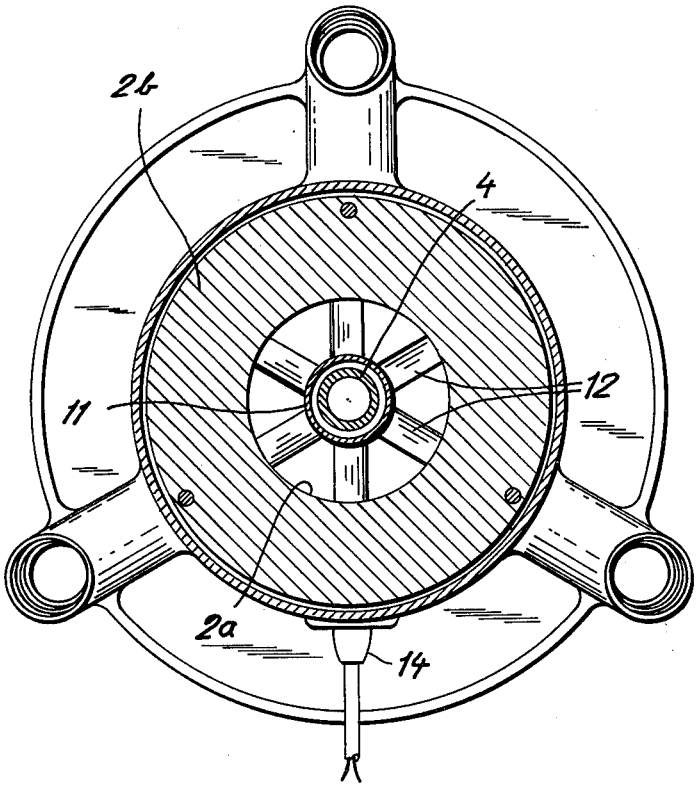
FIG. 3 is a cross-sectional view taken along the line III—III of FIG. 1

A series of vanes 12 are disposed immediately adjacent this plane between the sleeve 11 and the inner wall of the body **2*b* defining the passage 2*a*. These vanes 12 are disposed, as can be seen in FIG. 3 at an angle to the longitudinal axis of the nozzle 4 which is shosen as a function of the desired intensity of the "swirl", i.e. as a function of the value of the kinetic moment of rotation with respect to the axial mass flow of the comburant gas. These vanes thus determine the intensity of the toroidal vortex. The edges of these vanes (at the downstream side) are coplanar with the opening of the passage 10*a* and the mouth of the nozzle 4. The vanes 12 correct with considerable precision the swirl moment generated by the blading 6** previously described.

Between the aforementioned plane P, and the plane P' of the upstream end of the conical portion **7*a* of the flame pot 7, the flow passage 2*a* is provided with an annular constriction 13 which accelerates the gas flow in a highly local manner such that a reverse penetration of the toroidal vortex toward the nozzle 4 is precluded. The acceleration of the gas ends within the outwardly flared portion 7*a*. Thus the annular constriction 13 plays the role of a true dynamic barrier precluding movement of the toroidal vortex to the left and hence preventing deposits from forming within the passage 2*a***.

In practice, the blower 5 supplies the scroll 2 with air or mixture of air and combustion gases or any other gaseous comburant adapted to support combustion, the comburant being divided into two parts, of which the major part (of the order of 75–90%) passes through the fixed blading 6 and produces a swirl around the tube 11 and the nozzle 4.

The other portion of the comburant passes through the tube 11 and flows axially out of the passage 10*a* to blow the region of the nozzle 4 free from any particles of combustibles which might otherwise tend to encrust the nozzle 4.

This system also permits a central zone of relatively low discharge rate to be formed directly around the nozzle and hence to create conditions compatible with the combustibility of the mixture of the combustible (fuel) and of the comburant whereby ignition can be brought about by a pair of electrodes 14.

Since the annular constriction prevents movement of portions of the toroidal vortex to the left toward the discharge end of the nozzle, the vortex does not tend to grow toward the walls of the passage 2*a* and hence deposition of combustible particles on the walls of the opening or passage, on edges of the vanes 12 and on the walls of the sleeve 11 is precluded.

Tests have shown that, after dozens of hours of operation with the system of the present invention, there is absolutely no deposit of particles of combustibles or soot on any of the surfaces of the vanes 12 or the sleeve 11.

I claim:

1. A burner comprising:

a housing means defining an axially extending distribution passage extending from an upstream end to a downstream end and opening into a combustion chamber;

a nozzle for injecting a combustible into said chamber, said nozzle extending axially through said passage and terminating at an end of said nozzle within said passage;

means communicating with said upstream end of said passage for supplying a gaseous comburant thereto under pressure, said gaseous comburant passing through said passage and mixing with the combustible emerging from said end of said nozzle to form a combustible mixture in said chamber;

means along said passage for imparting a swirl to the gaseous comburant traversing said passage, thereby inducing said mixture to form a toroidal vortex downstream of said end of said nozzle;

a constriction in said passage immediately downstream of said end of said nozzle for accelerating the flow of said comburant therethrough at said constriction and producing a dynamic barrier to movement of said toroidal vortex toward said nozzle;

a duct extending downstream from said constriction and flaring away therefrom;

means forming an annular chamber surrounding said nozzle at least in the region thereof adjacent said end of said nozzle and open axially in the downstream direction; and means for feeding a portion of said comburant to said chamber for flow along said nozzle, the means forming said chamber comprising a tubular sleeve surrounding said nozzle and terminating in a plane of said end of said nozzle perpendicular to the axis of said nozzle, the swirl-inducing means including vanes surrounding said sleeve and terminating at said plane, the means for supplying said comburant to said passage including a scroll disposed at the upstream end of said passage, fixed blading between said scroll and said passage for imparting an initial torque to the comburant fed to said passage, and a blower disposed laterally of said scroll for feeding said comburant tangentially thereto, the means for supplying a portion of the comburant to said chamber including a compartment surrounding said nozzle and opening axially into said chamber, and at least one radial bore communicating between the interior of said scroll and said passage.

2. The burner defined in claim 1, further comprising a nozzle carrier, said compartment being formed in said nozzle carrier, said sleeve being mounted in said nozzle carrier and said fixed blading being formed on a disk secured to said nozzle carrier.

3. The burner defined in claim 2 wherein said constriction is a frustocone received in a body defining said passage.

4. The burner defined in claim 3 wherein said flaring duct is a frustocone having its upstream side coplanar with the downstream side of said constriction.

5. The burner defined in claim 4 wherein said constriction has its conical apex substantially coincident with the plane of the downstream side of said duct, said duct opening into a cylindrical flame-pot portion at said downstream side, said duct having its conical apex upstream of said end of said nozzle.

6. In a burner for a combustible fluid having an opening for distribution of a comburant adapted to discharge into a combustion chamber, a source of gaseous comburant under pressure, a swirl generator between said source and said opening, an injection nozzle for a combustible fluid extending coaxially through at least part of said opening and terminating immediately upstream of a constriction thereof, an outwardly flared member extending away from said constriction downstream thereof so as to impart to a comburant traversing said constriction an acceleration adapted to restrain the toroidal vortex resulting from said swirl from receding toward said nozzle, the improvement which comprises:

a tubular wall concentrically surrounding said nozzle and spaced therefrom while extending along said nozzle to subdivide said opening into a central annular passage between said wall and the nozzle and an outer annular passage around said wall, said outer annular passage being connected to said source of gaseous comburant through said swirl generator whereas said central annular passage is connected to the same source while bypassing said swirl generator so that the velocity of the comburant in said central passage and from said central passage to said constriction is lower than the velocity in said outer passage to permit ignition of a combustible/comburant mixture adjacent said nozzle, said tubular wall terminating in the same plane perpendicular to its axis as said nozzle.

* * * * *